US007654317B2

(12) United States Patent
Uitto

(10) Patent No.: US 7,654,317 B2
(45) Date of Patent: Feb. 2, 2010

(54) DRILL HOLE MEASURING DEVICE AND ROCK DRILLING UNIT

(75) Inventor: Vesa Uitto, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 366 days.

(21) Appl. No.: 10/552,699

(22) PCT Filed: Apr. 8, 2004

(86) PCT No.: PCT/FI2004/000219

§ 371 (c)(1),
(2), (4) Date: Oct. 7, 2005

(87) PCT Pub. No.: WO2004/090287

PCT Pub. Date: Oct. 21, 2004

(65) Prior Publication Data

US 2007/0056364 A1 Mar. 15, 2007

(30) Foreign Application Priority Data

Apr. 11, 2003 (FI) ..... 20030553

(51) Int. Cl.
*E21B 47/01* (2006.01)

(52) U.S. Cl. ..... 166/250.01; 166/250.11; 73/152.54; 175/40

(58) Field of Classification Search ..... 166/250.01, 166/250.11; 175/40, 45; 73/152.54
See application file for complete search history.

(56) References Cited

U.S. PATENT DOCUMENTS 3,693,729 A * 9/1972 Blurton et al. ..... 173/189
3,904,840 A * 9/1975 Kostelnicek ..... 340/855.1
4,047,430 A * 9/1977 Angehrn ..... 73/152.02
4,573,805 A * 3/1986 Savage et al. ..... 374/136
5,305,830 A * 4/1994 Wittrisch ..... 166/250.01
5,729,206 A * 3/1998 Divens ..... 340/618
5,812,068 A 9/1998 Wisler et al.
6,460,630 B2 10/2002 Ahtola et al.
6,497,281 B2 * 12/2002 Vann ..... 166/369

FOREIGN PATENT DOCUMENTS

| | | |
|---|---|---|
| JP | 59-112218 | 6/1984 |
| JP | 5-306933 | 11/1993 |
| JP | 6-502000 | 3/1994 |
| JP | 8-313251 | 11/1996 |
| JP | 2002-531741 | 9/2002 |
| JP | 2002-357418 | 12/2002 |
| WO | 92/06279 | 4/1992 |
| WO | 96/22547 | 7/1996 |
| WO | 00/34617 | 6/2000 |
| WO | 00/34623 | 6/2000 |

OTHER PUBLICATIONS

European Search Report mailed Dec. 27, 2007 issued in European Application No. 07117811.5.
English translation of Notification of Reason for Refusal mailed Jul. 14, 2009 issued in Japanese Application No. 2006-505634.

* cited by examiner

*Primary Examiner*—Kenneth Thompson
(74) *Attorney, Agent, or Firm*—Drinker Biddle & Reath LLP

(57) ABSTRACT

A drill hole measuring device and a rock drilling unit equipped with the measuring device. The measuring device (1) comprises a protective element (3), inside which a sensor (6) can be transferred by means of a transfer device (4).

17 Claims, 3 Drawing Sheets

DRILL HOLE MEASURING DEVICE AND ROCK DRILLING UNIT

BACKGROUND OF THE INVENTION

The invention relates to a drill hole measuring device comprising: a frame; at least one sensor; an elongated transmission element connected to the sensor; at least one transfer device, by which the transmission element can be moved longitudinally in at least one direction for moving the sensor in the drill hole.

The invention also relates to a rock drilling unit comprising: at least one feeding beam; at least one rock drilling apparatus, which is movable with respect to the feeding beam; and at least one measuring device for measuring drill holes, the measuring device comprising: a frame; at least one sensor that can be arranged in a drill hole; an elongated transmission element connected to the sensor; and at least one transfer device, by which the transmission element can be moved longitudinally for moving the sensor in the drill hole.

In measuring the straightness and dimensions of downward-oriented drill holes it is typical that a sensor, supported by a cable, is lowered into the drill hole. The measuring device may comprise a winch, by which the sensor can be lowered and lifted in the drill hole. Alternatively the measuring device can be arranged in connection with the drilling boom, whereby the sensor is inserted into the drill hole by means of a suitable transfer device and a flexible transmission element, such as a hose or a rod. A device of this kind is disclosed in U.S. Pat. No. 6,460,630. Prior art solutions, however, have a draw-back that the handling of the sensors is difficult and while being transferred the sensor is subjected to knocks and mechanical stress. Sensitive sensors may get damaged and both measuring inaccuracy and extra costs may occur.

BRIEF DESCRIPTION OF THE INVENTION

The object of the present invention is to provide a novel and improved measuring device for measuring holes drilled in the rock, and also a rock drilling unit equipped with this measuring device.

The measuring device of the invention is characterized in that the measuring device includes an elongated protective element and that a sensor is arranged to be moved into the protective element by means of a transfer device.

The rock drilling unit of the invention is characterized in that the measuring device includes an elongated protective element, into which a sensor can be transferred by means of a transfer device.

The basic idea of the invention is that the measuring device comprises a protective element, into which a sensor can be transferred by means of a transfer device.

The invention has an advantage that a sensitive and expensive sensor is well protected inside the protective element when the measuring device is transported and transferred. Thus, it is possible to prevent the sensor from getting damaged.

The basic idea of one embodiment of the invention is that the measuring device is a portable device, which is transferred to holes to be measured. The sensor is moved into the protective element for transport from hole to hole.

The basic idea of one embodiment of the invention is that the measuring device is a portable device, in which the protective element is a substantially rigid piece, which forms a part of the measuring device frame. At the upper end of the protective element there is a transfer device, by which the transmission element can be moved. The transfer device may comprise a reel around which a flexible transmission element can be wound. The reel can be operated by a motor or the reel can be provided with a handle or the like which allows its manual operation. At the upper end of the protective element there may be a control unit for storing and processing measurement data.

The basic idea of one embodiment of the invention is that at the lower end of the protective element there are means for supporting the protective element to be essentially aligned and parallel to the hole. At the lower end of the protective element there may also be means for supporting the mouth of the drill hole and prevent stone material from falling into the drill hole.

The basic idea of one embodiment of the invention is that the protective element is at least partly outside of the hole measured and substantially stationary during the measurement operation.

The basic idea of one embodiment of the invention is that the measuring device is arranged in connection with the drilling unit. The measuring device can be arranged in a holder in the front portion of the feeding beam, whereby the measuring device can be used for measuring the drill holes. Further, the feeding beam may comprise a second holder in the rear portion of the feeding beam, for instance. In that case the measuring device or at least the sensor of the measuring device can be arranged in the second holder for the duration of drilling or charging, and consequently the measuring device can be utilized in positioning and aligning of the drilling unit. The second holder is arranged in such a manner that the drilling unit will not cause substantial disturbance to the sensors used.

The basic idea of one embodiment of the invention is that in connection with the measuring device there is at least one actuator, by which the protective element can be inserted as deep as desired in the drill hole. Once the protective element is inserted in the drill hole, the sensor is transferred inside the protective element, by means of the transmission element, into the drill hole. Thus the sensor is safe from wear and tear inside the protective element.

The basic idea of one embodiment of the invention is that the protective element is a tubular piece.

BRIEF DESCRIPTION OF THE DRAWINGS

In the following, the invention will be described in greater detail, with reference to the attached drawings, wherein.

For the sake of clarity, the invention is presented in a simplified manner in the figures. Like parts are indicated by like reference numerals in the figures.

DETAILED DESCRIPTION OF THE INVENTION

Figure 1:
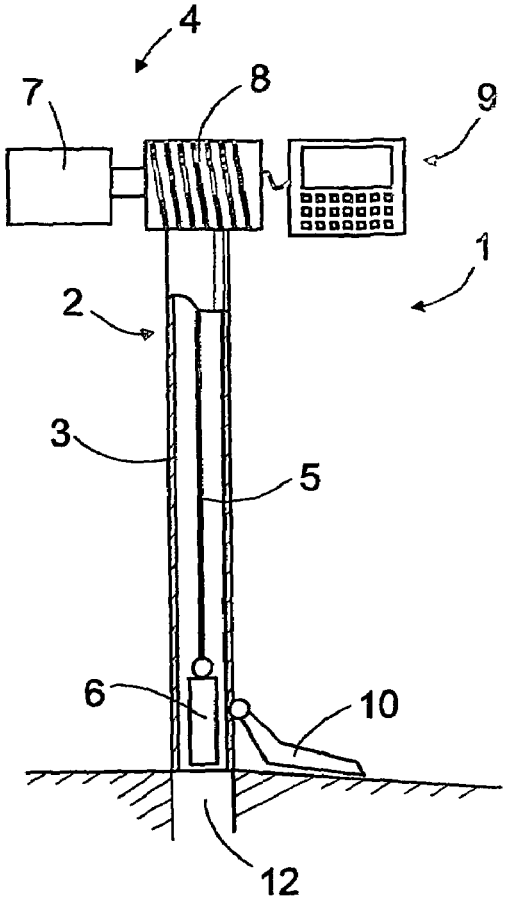
FIG. 1 is a schematic side view of a portable measuring device according to the invention.

The portable measuring device 1 of FIG. 1 comprises a frame 2, which may include an elongated protective element 3. The protective element 3 may be a substantially rigid piece. In the upper part of the protective element 3 there is transfer device 4, which is arranged to move a sensor 6 by means of a flexible transmission element 5. The transfer device 4 may comprise a motor 7, which is arranged to rotate a reel 8, around which the transmission element 5 can be wound and from which it can be unwound correspondingly. The motor 7 can be a battery-operated electric motor, for instance. The transfer device 4 may comprise necessary brake mechanisms and power transmission menas in order to allow the sensor 6 to be moved in the drill hole in a desired manner. The transmission element 5 may be, for instance, a flexible hose, a cable or a corresponding means. When downward-oriented drill holes 12 are measured the sensor 6 can be lowered by the action of gravity into the drill hole 12, whereby the transmission element 5 is only required to be rigid to allow pulling. Whereas, in situations, where the sensor 6 is pushed into the drill hole by means of the transmission element 5, the transmission element 5 should be rigid to allow both pushing and pulling. The lower end of the protective element 3 is open and designed such that by means of the transfer device 4 the sensor 6 can be drawn inside the protective element 3, where the sensor 6 can be protected from damage when the measuring device 1 is transferred, transported, and stored, for instance. The protective element 3 can be made of metal or plastic material, for instance, or a composite material made of two or more materials, such as reinforced plastic. The protective element 3 can be a tubular piece and its cross-section can be round, oval or angular and the shape of the cross-section may change between the upper end and the lower end. The length of the protective element 3 can be arranged such that the transfer device 4 at the upper end of the protective element 3 and the control unit 9 will be located at a user-friendly height thus improving the operability of the measuring device 1. It is also possible to arrange the fastening of the transfer device 4 and the control unit 9 in such a manner that their altitude with respect to the upper end of the protective element 3 can be adjusted according to the needs of each individual user. Further, at the lower end of the protective element 3 there can be a support means 10, by means of which the measuring device 1 can be supported to the hole, in this example a vertical hole. When the measuring device 1 is able to stand independently supported parallel to the hole, the measuring operation is substantially facilitated. The support means 10 can be connected to the protective element 3 with an articulation, for instance, which allows the support means being turned to be in parallel with the protective element 3 during transportation and storage. In addition, the adjustable support means 10 enables the measuring device 1 being also supported to an inclined surface. If so desired, the measuring device 1 can also be supported in a slightly slanted position.

The sensor 6 may comprise, for instance, inclination sensors, acceleration sensors, magnetometers, a compass, gyrosensors, a GPS or other positioning units or any other device suitable for measuring the drill hole 12. Further, there may be more than one sensor 6, whereby various measurements can be carried out at the same time. The sensor 6 may be arranged inside a suitable protecting tube or a corresponding casing such that effects of moisture and mechanical stress can be prevented. The whole formed by the sensor 6 and its casing is designed such that it can be drawn inside the protective element 3 completely or at least partly. The sensor 6 may have a wired or wireless connection to the control unit 9. A data transfer cable or the like can be arranged to pass inside a hose-like transmission element 5. It is also possible to use a conductive transmission element 5, whereby the transmission element 5 may convey measurement data.

The control unit 9 may comprise a computer or a corresponding processor for collecting and processing measurement data obtained from the sensor 6. The control unit 9 may also comprise a memory means for storing the measurement data and also a data transfer connection for transferring data between the control unit 9 and external devices. The data transfer connection may be wireless or wired. The control unit 9 may also comprise means for reading and writing memory discs and the like. Furthermore, the control unit 9 may allow execution of a computer program that can be arranged to control movements of the sensor 6 in the drill hole and to carry out measurements. It is yet possible that the execution of the computer program provides automatic execution of a measuring sequence. The measuring sequence may be predetermined, or alternatively, the sequence may be generated at least in part in the course of the measuring.

Figure 2:
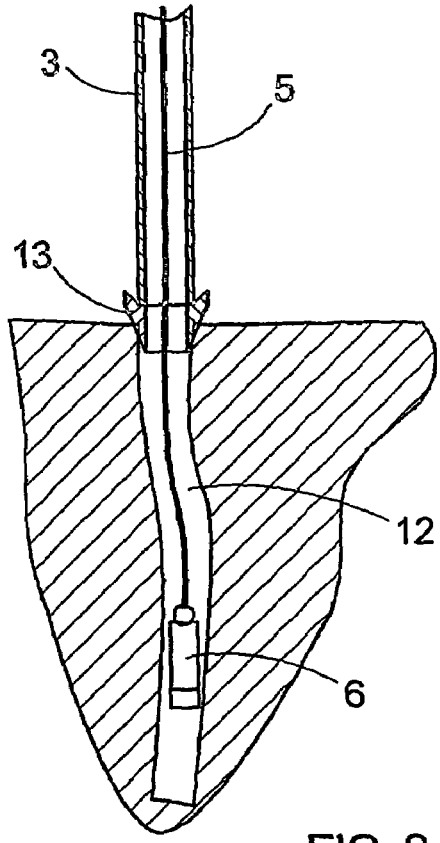
FIG. 2 is a schematic view of a part of the measuring device according to the invention.

FIG. 2 shows a part of another measuring device 1. At the lower end of the protective element 3 there is a conical portion 11, which is designed such that it may be inserted at least partly in the drill hole 12. Thus the conical portion 11 can prevent stones from falling into the drill hole as well as the mouth of the drill hole from collapsing. The lower part of the protective element 3 can be designed conical, or alternatively, a separate, conical part 13 can be secured to the lower end of the protective element 3. The conical portion 11 can have such dimensions and shape that it is capable of holding the measuring device 1 independently in an upright position, or the lower part of the protective element 3 can be additionally provided with a support means 10.

Figure 3:
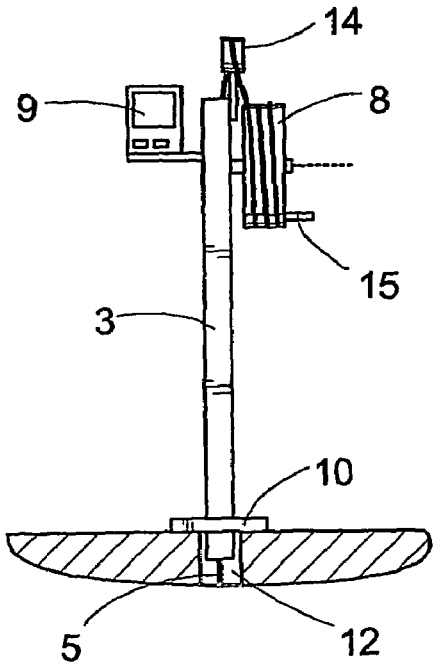
FIG. 3 is a schematic side view of a second portable measuring device according to the invention.

FIG. 3 shows yet another portable measuring device 1, in which the lower part of the protective element 3 is designed such that it can be inserted into the drill hole 12 for at least a predetermined portion, whereby stones can be prevented from falling into the drill hole 12. Further, the support means 10 can be a flange that is supported to the rock surface and is able to keep the protective element 3 in upright position. The upper end of the protective element 3 can be open and it can be provided with a sheave 14, through which the transmission element is arranged to run onto the reel 8. The reel 8 can be manually operated and it can be provided with a handle 15 or the like to facilitate rotating. The upper end of the protective element may also comprise a rack 16, onto which the control unit 9 can be detachably mounted.

Figure 4:
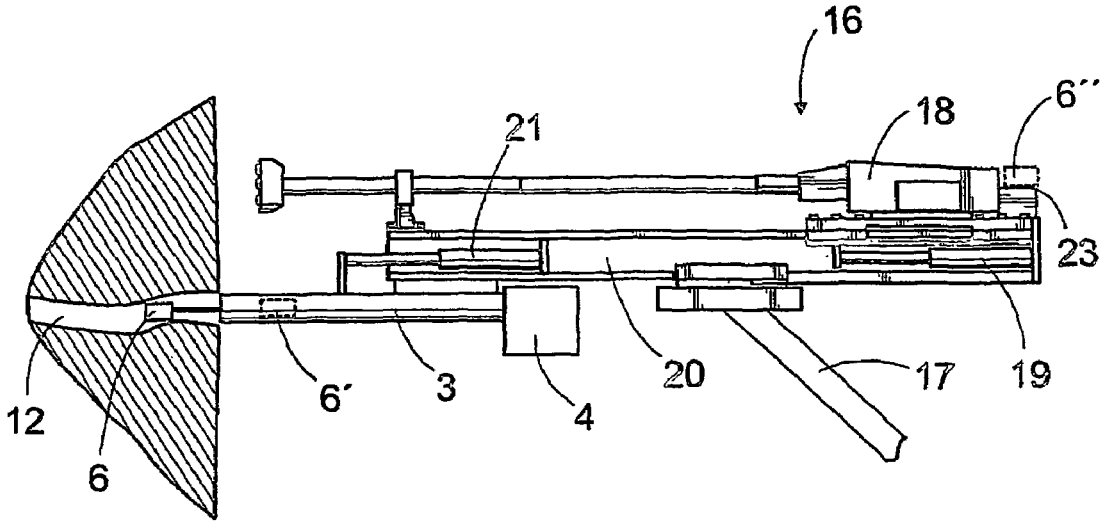
FIG. 4 is a schematic view of a measuring device according to the invention arranged in connection with a drilling unit.

FIG. 4 shows a measuring device 1, which is arranged in connection with a drilling unit 16 belonging to the rock drilling rig. The drilling unit 16 is arranged at the free end of the drilling boom 17. The drilling unit 16 comprises at least a rock drilling apparatus 18 that can be moved on a feeding beam 20 by means of feeding means 19. The drilling unit 16 may further comprise an indexable feeding/charging device (not shown). The measuring device 1 can be arranged in the front portion of the feeding beam 20. In connection with the measuring device 1 there can be an actuator 21, such as an electric motor or a pressure medium cylinder, by which the measuring device can be moved in the longitudinal direction of the feeding beam 20. Thus, the measuring device 1 can be pushed forward, when measuring starts. For the duration of drilling, and when measurings are not performed, the measuring device 1 can be driven to its retracted position by means of the actuator 21. In addition, the sensor 6 can be drawn to safety inside the protective element 3 by means of the transfer device 4. In this case the transfer device 4 can comprise an electric motor or a pressure-medium-operated device. The control unit 9 in connection with measuring device 1 can convey the measurement data over its data transfer connection to the carrier of the rock drilling apparatus or to transmit the measurement data wirelessly directly to the control room of the mining site, for instance, for further processing of the data.

Figure 5:
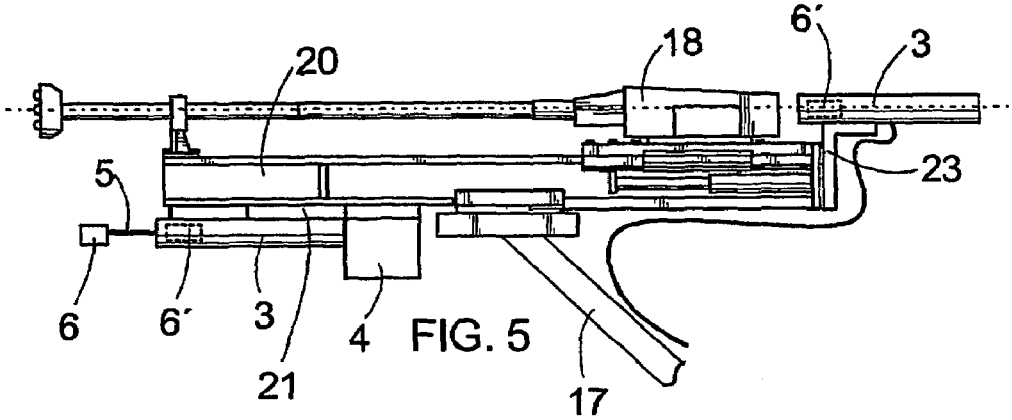
FIG. 5 is a schematic view of a second measuring device according to the invention arranged in connection with a drilling unit.

FIG. 5 shows an option, in which the measuring device 1 is a detachable unit that can be arranged in first holders 22 in the front part of the feeding beam 20 when drill holes 12 are being measured. Further, the drilling unit 16 can be provided with second holders 23, which are arranged such that the measuring device 1 can be mounted substantially coaxially with the drill machine 18. In case the measuring device 1 cannot be placed on the axis of the rock drilling apparatus 18, the position of the drilling axis can be determined by calculation. The second holders 23 may be located in the rear portion of the feeding beam 20 and they may be provided such that the measuring device 1 with its sensitive sensors 6 are located far enough from the drilling unit 16. Thus the magnetism and vibrations in the drilling unit 16 do not disturb the operation of the sensors 6. There can exist a data transfer connection from the measuring device 1 to the control unit located on the carrier of the rock drilling apparatus and controlling the operation of the drilling unit. This solution has an advantage that the measuring device 1 can be utilized both for measuring the drill holes 12 and, during drilling, for positioning the rock drilling apparatus 18 in locations determined in a drilling plan. Furthermore, when the drilling unit 16 is provided with a feeder of an explosive, reinforcement or some other substance, the drilling unit 16 can be directed by means of position data obtained from the measuring device 1. All in all, the solution enables versatile and efficient use of the expensive sensors 6.

In connection with the transfer device 4 there may be means for charging energy when the sensor 6 is lowered into the drill hole 12 by gravity.

The transfer device 4 may also be arranged to utilize the stored energy later on, when it is time to lift the sensor 6 up from the drill hole 12. One option is to arrange a spring mechanism in connection with the transfer device 4, in which it is possible to charge potential energy released during the lowering. This solution is suitable both for manual and for motor-operated transfer devices 4. Another option is to arrange means in connection with the transfer device 4, which generate electric energy while the sensor 6 is lowered, and which energy can be charged in batteries and utilized later on when the sensor 6 is lifted from the drill hole 12 by means of the electric motor.

In addition to the above-mentioned solutions, one option is that the transfer device 4 comprises a pressure medium cylinder for moving the sensor 6. Further, when relatively short drill holes are measured, the transfer device 4 need not necessarily have a reel 8, but alternatively the transmission element 5 can be arranged to form a loop or it can be otherwise supported to the feeding beam 20. The transfer device 4 may also include one or more roll-like means that is arranged to move the transmission element by friction.

Figure 6:
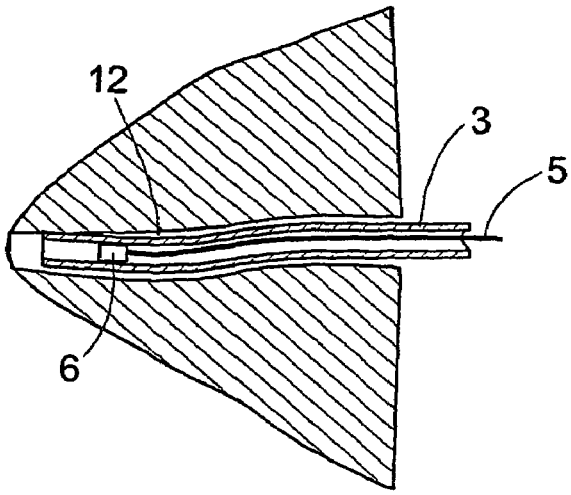
FIG. 6 is yet a schematic view of a part of the measuring device according to the invention cut open.

FIG. 6 shows an alternative solution, in which the protective element 3 of the measuring device 1 is pushed into the drill hole 12. Thereafter the sensor 6 is pushed inside the protective element 3 into the drill hole 12 by means of the transmission element 5. Thus it is easy to move the sensor 6 inside the protective element 3. The protective element 3 can be flexible, which allows insertion also into a drill hole 12 that is curved in shape. The protective element 3 can be a hose made of a suitable plastic material or a combination of a plastic material and a reinforcement substance. The protective element 3 can be moved with a suitable actuator 21. Because the sensor 6 is inside the protective element 3, it is not subjected to strong mechanical stresses during the measuring. In addition, the sensor 6 is safe within the protective element 3 during transfers and drilling. It is further possible to draw the sensor 6 completely out of the protective element 3 and feed for instance explosives or reinforcement cartridges along the protective element 3 into the drill hole 12. It is also possible to feed also other sensors into the drill hole 12 along the protective element 3. Furthermore, the sensor 6 can be changeable, which allows a necessary sensor to be connected to the transmission element 5.

Figure 7:
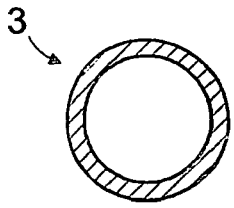
FIGS. 7 to 10 show schematically optional cross-sections of a protective element.
Figure 8:
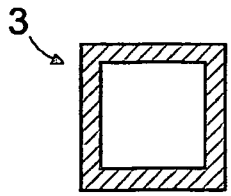
Figure 9:
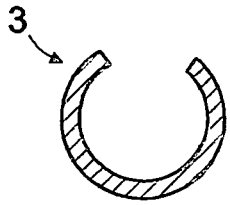
Figure 10:
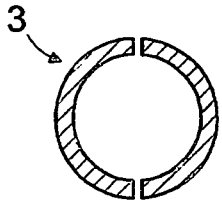

FIGS. 7 to 10 show some optional cross-sections of the protective element 3. In FIG. 7 the cross-section is circular and in FIG. 8 the inner and outer surfaces of the tubular cross-section are rectangular. Further, in FIG. 9 the cross-section is groove-like and in FIG. 10 the protective pipe 3 consists of two halves.

Figure 11:
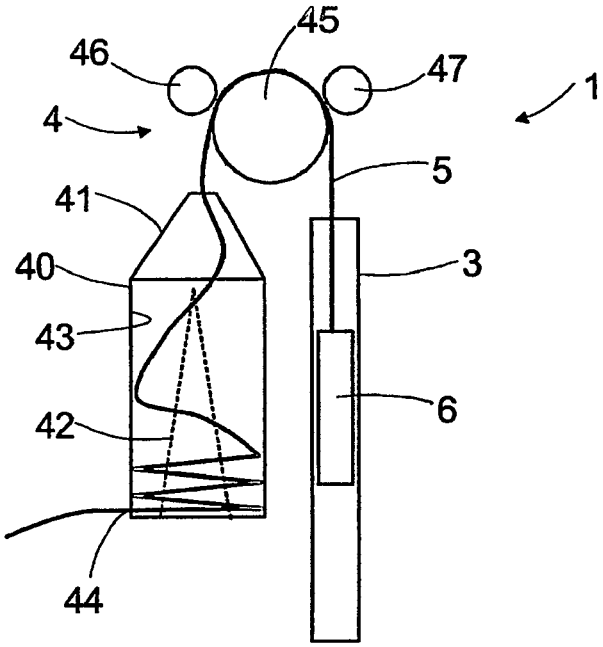
FIG. 11 is a schematic side view of one alternative measuring device.

FIG. 11 shows a measuring device 1, which comprises a container 40, into which the flexible transmission element 5 can be stored. The measuring device 1 comprises no reel, but the transmission element 5 loops in good order inside the container 40. The container 40 may be arranged stationary with respect to the frame of the measuring device 1. The running of the transmission element 5 into the container 40 can be guided by means of a first guiding piece 41 in the upper part of the container 40 and further by means of a second guiding piece 42 arranged inside the container 40. The guiding piece 42 can be secured to the bottom of the container 40 and it can be an upwardly tapering cone. Thus the transmission element 5 descends controllably and in good order into a space between the inner surface 43 of the container and the second guiding piece 42. The rigidity of the transmission element 5 further contributes to its settling inside the container 40. The container 40 may also have an opening, through which the transmission element 5 can run out of the container. In this solution the transfer device 4 comprises rolls 45, 46, 47, which are arranged to affect the transmission element 5 by friction. The transmission element 5 can be a chain or a cable, for instance. One advantage of this solution is that no significant rotation moment is produced to the transmission element 5 during transmission, as is the case when the transmission element 5 is wound around a rotating reel. If the measurement data obtained from the sensor 6 is conveyed through data transfer cables in connection with the transmission element 5 to the control unit 9, a slip-ring mechanism or the like must be used, which allows the cable to rotate but maintains the electric contact. This structure makes it possible to do without the slip-ring mechanism and the like.

Figure 12:
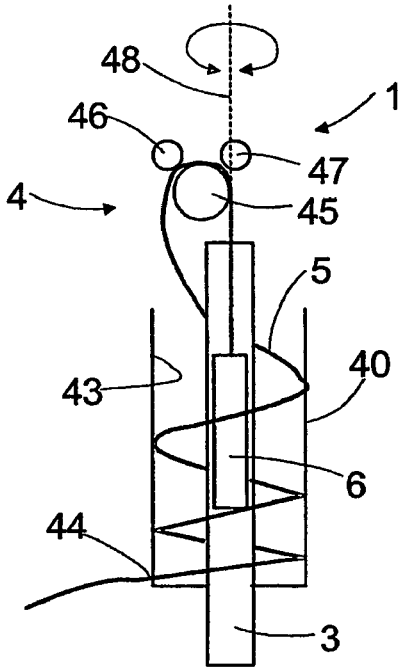
FIG. 12 is a schematic side view of yet another measuring device.

FIG. 12 shows another option to avoid rotation moment in the transmission element 5 and thereby a need for a slip-ring mechanism or the like. In the solution of FIG. 12, the container 40 is arranged around the protective element 3, and consequently the structure takes little space and together with the inner surface 43 of the container the protective element 3 can guide the transmission element 5 to descend into the container 40. The container 40 is arranged stationary with respect to the frame of the measuring device 1. The transfer device 4 may comprise a desired number of rolls 45, 46, 47 to the effect that the transmission element 5 can be moved by friction. Further, the transfer device 4 is arranged rotatably about the longitudinal axis 48 of the protective element 3.

Figure 13:
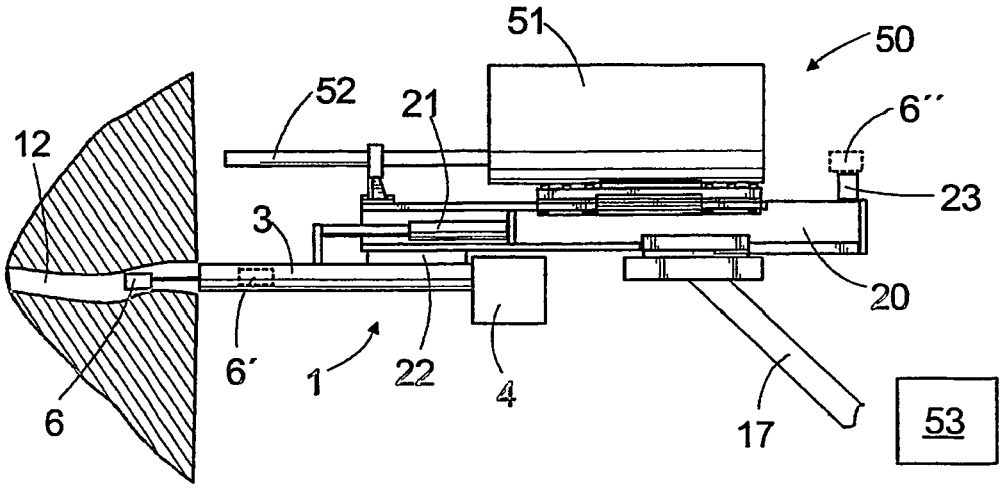
FIG. 13 is a schematic side view of a charging device equipped with the measuring device of the invention.

FIG. 13 shows a charging unit 50, which is arranged at the free end of the boom 17. The charging unit 50 may comprise a magazine 51, which can be loaded with explosive cartridges, reinforcement cartridges or other cartridges to be charged into the drill hole 12. From the magazine 51 the cartridges can be transferred pneumatically into a feed pipe 52 and further into the drill hole 12. The construction and operating principle of the charging unit 50 may also be other than that described. It is essential that the charging unit 50 is provided with the measuring device 1 according to the invention. By means of the measuring device 1 it is possible to check, for instance, the quality, straightness and rock type of the drill hole prior to charging. Measurement data can thus be taken into account in charging. On the basis of the measurement it is possible to control the amount of explosives, for instance. The measuring device 1 can be arranged on the feeding beam 20 of the charging device 50 with first holders 22 and it can be moved by means of the actuator 21.

In addition to the above-mentioned rock drilling and charging units it is possible to utilize the measuring device according to the invention in other rock excavation machines for measuring drill holes. If necessary, the measuring device according to the invention can be mounted on an unmanned measuring vehicle, for instance.

FIGS. 4 and 13 show yet another application, in which the sensor 6" is detached, when necessary, from the measuring device 1 and it is arranged in second holders 23 on the feeding beam 20. So, in addition to measuring the drill holes, the sensor 6" can be used for positioning and aligning the feeding beam 20. This enables more versatile utilization of the sensor 6". In connection with the second holders 23 there can be contact means, by means of which the sensor 6" can be connected through a wired data transfer connection to the control system 53 of the charging device 50. On the other hand, when the sensor 6" comprises means for establishing a wireless data transfer connection, said contact means are not needed. In connection with the second holders there can also be means for protecting the sensor 6" against impurities and impacts. The described arrangements can be applied to all kinds of rock excavation machines.

The drawings and the relating description are only intended to illustrate the inventive idea. The details of the invention may vary within the scope of the claims.

The invention claimed is:

1. A portable drill hole measuring device comprising:

a frame including a surface mounted elongated protective element comprising a lower part and an upper part;

at least one sensor;

an elongated flexible transmission element connected to the sensor;

at least one transfer device mounted to the frame, by which the transmission element can be moved longitudinally in at least one direction for moving the sensor in the drill hole;

and the transfer device comprises a reel, around which the transmission element can be wound, the lower part of the protective element is designed such that it can be inserted partly into the drill hole, and wherein the sensor is arranged to be moved into the protective element by means of the transfer device for transport to said drill hole and wherein the sensor is arranged to be moved outside the lower part of the protective element for performing measurement of an uncased drill hole.

2. A measuring device as claimed in claim 1, wherein at a first end of the protective element there is a conical portion, which can be inserted into the drill hole at least partly.

3. A measuring device as claimed in claim 1, wherein at a first end of the protective element there is at least one support piece, which is arranged to hold the protective element in an upright position.

4. A measuring device as claimed in claim 1, wherein the protective element is designed at least for a first end of the protective element such that the protective element can be inserted at least partly into the drill hole.

5. A measuring device as claimed in claim 1, wherein the protective element is a tubular piece.

6. A measuring device as claimed in claim 1, wherein the transfer device is provided with a handle for rotating the reel manually.

7. A measuring device as claimed in claim 1, wherein the transfer device comprises a motor for rotating the reel.

8. A measuring device as claimed claim 1, wherein the measuring device comprises at least one actuator for pushing the protective element partly into the drill hole.

9. A measuring device as claimed in claim 1, wherein the transmission element is a flexible, elongated piece, the measuring device comprises a container, which is arranged stationary with respect to a frame of the measuring device, for storing the transmission element, the transfer device comprises at least one roll, which is arranged to move the transmission element in the longitudinal direction by friction, and the transmission element is arranged to settle within a space delimited by an inner surface of the container.

10. A measuring device as claimed in claim 1, wherein the transmission element is a flexible, elongated piece, the measuring device comprises a container, which is arranged stationary with respect to a frame of the measuring device, for storing the transmission element, the transfer device comprises at least one roll, which is arranged to move the transmission element in a longitudinal direction by friction, the transfer device is arranged rotatably about the longitudinal axis of the protective element, and the transmission element is arranged to settle within a space delimited by an inner surface of the container.

11. A measuring device as claimed in claim 1, wherein the measuring device is arranged in a rock drilling unit.

12. A measuring device as claimed in claim 1, wherein the measuring device is arranged in a charging unit, which comprises a magazine from which cartridges are charged into a drill hole.

13. A measuring device as claimed in claim 1, wherein the transmission element is hose-like and is provided with a data transfer cable.

14. A rock drilling unit comprising:

at least one elongated feeding beam;

at least one rock drilling apparatus, which is movable on the feeding beam;

and at least one measuring device for measuring drill holes, the measuring device comprising: a frame; at least one sensor that may be arranged in a drill hole; an elongated transmission element connected to the sensor; and at least one transfer device, by which the transmission element may be moved longitudinally for moving the sensor in the drill hole, and wherein, the measuring device includes an elongated protective element, into which the sensor is arranged to be moved by means of the transfer device.

15. A rock drilling unit as claimed in claim 14, wherein a first end portion of the feeding beam comprises a first holder for mounting the measuring device, and a second end portion of the feeding beam comprises a second holder for mounting at least the sensor of the measuring device, the measuring device is mountable on the first holder for measuring the drill hole by means of the sensor, and at least the sensor of the measuring device is mountable on the second holder for positioning and aligning the drilling unit by means of the sensor.

16. A rock drilling unit as claimed in claim 14, the rock drilling unit comprises at least one actuator for moving the protective element of the measuring device longitudinally, the protective element can be inserted into the drill hole, and the sensor can be inserted inside the protective element into the drill hole.

17. A rock drilling unit as claimed in claim 13, wherein the measuring device comprises a control unit, and a data transfer cable is arranged between the sensor and the control unit.

* * * * *